US011542639B2

(12) United States Patent
Cheynet

(10) Patent No.: US 11,542,639 B2
(45) Date of Patent: Jan. 3, 2023

(54) DOUBLE-FACE ELASTIC FABRIC WITH HOOK-AND-LOOP PROPERTIES

(71) Applicants: BERTHEAS & CIE, Saint Chamond (FR); Jean-pierre Cheynet, Saint Maurice en Gourgois (FR)

(72) Inventor: Jean-pierre Cheynet, Saint Maurice en Gourgois (FR)

(73) Assignees: BERTHEAS & CIE, Saint Chamond (FR); Jean-pierre Cheynet, Saint Maurice en Gourgois (FR)

( * ) Notice: Subject to any disclaimer, the term of this patent is extended or adjusted under 35 U.S.C. 154(b) by 560 days.

(21) Appl. No.: 16/794,762

(22) Filed: Feb. 19, 2020

(65) Prior Publication Data

US 2020/0275744 A1 Sep. 3, 2020

(30) Foreign Application Priority Data

Feb. 22, 2019 (FR) ..... 1901813

(51) Int. Cl.

| | |
|---|---|
| ***A44B 18/00*** | (2006.01) |
| ***D03D 15/49*** | (2021.01) |
| ***D03D 15/56*** | (2021.01) |
| ***D03D 15/47*** | (2021.01) |
| ***D03D 1/00*** | (2006.01) |
| ***D03D 13/00*** | (2006.01) |
| ***D03D 15/283*** | (2021.01) |

(52) U.S. Cl.

CPC ..... *D03D 15/49* (2021.01); *A44B 18/0084* (2013.01); *D03D 1/00* (2013.01); *D03D 13/004* (2013.01); *D03D 15/283* (2021.01); *D03D 15/47* (2021.01); *D03D 15/56* (2021.01); *A44B 18/0023* (2013.01); *D10B 2331/02* (2013.01); *Y10T 428/24008* (2015.01)

(58) Field of Classification Search

None

See application file for complete search history.

(56) References Cited

FOREIGN PATENT DOCUMENTS

| | | |
|---|---|---|
| EP | 0670383 A1 | 9/1995 |
| EP | 1593764 A1 | 11/2005 |

OTHER PUBLICATIONS

Search Report issued in French Patent Application No. 1901813 dated Jan. 7, 2020.

*Primary Examiner* — Alexander S Thomas

(74) *Attorney, Agent, or Firm* — Marshall, Gerstein & Borun LLP

(57) ABSTRACT

A double-face fabric having elastic properties in its warp direction and provided with hook-and-loop properties, formed by the weaving of warp yarns and of weft yarns. The warp yarns are of four different types worked in different weaves with respect to the weft yarns, respectively: elastic yarns (A) worked in a taffeta weave; core yarns (B), formed of synthetic yarns texturized by false twist on the face, worked in a plain weave alternating with surface floats and having a linear strand density in the range from 10 to 25 dtex; core yarns (C) on the back side, formed of multifilament synthetic yarns, having a linear strand density in the range from 0.3 to 1.7 dtex, worked in a rep weave, alternating floats of great length on the back side and short binding areas on the face side, binding yarns, exclusively formed of thermo-adhesive synthetic yarns, having a melting point in the range from 80° C. to 160° C., worked in a plain weave.

8 Claims, 3 Drawing Sheets

DOUBLE-FACE ELASTIC FABRIC WITH HOOK-AND-LOOP PROPERTIES

DOMAIN OF THE INVENTION

The invention pertains to the field of elastic fabrics, provided with hook-and-loop properties. Such fabrics are particularly meant to be used is the manufacturing of underwear, of clothes, or also of orthopedic compression articles or others.

BACKGROUND

It is known, more particularly in the field of orthopedic garments, to use warp and weft fabrics, elastic in the warp direction, and having one of their sides provided with apparent loops, intended to form the female element of a hook-and-loop fastening system, of the type well known under trade name Velcro®.

To manufacture such articles, it is known to use in the warp direction a combination of highly elastic yarn, of covered yarn type, formed of a core made of elastodiene, preferably of elastofiber, such as elastane, and of a synthetic yarn covering. Further, to form the surface forming the female element with hook-and-loop properties, and thus typically formed of apparent loops, a synthetic yarn having a linear strand density typically in the range from 10 to 25 dtex is used.

Experience shows that if, indeed, the fabrics thus formed are satisfactory in terms of efficiency of the hook-and-loop properties and of elasticity, they however have a number of disadvantages. Thus, the apparent free-standing loops intended to receive the hooks of the male element of the hook-and-loop system, have a certain stiffness due to the linear strand density of the yarns used necessary for the durability, so that their height with respect to the actual fabric is non-negligible, typically in the order of 5 millimeters or even more, which provides a relatively significant thickness to the article on the one hand and, on the other hand, generates a hand considered unpleasant.

Further, due to the relatively significant height of the loops, the latter prove being more vulnerable to mechanical aggressions. Thus, there may occur, during finishing operations or treatments, such as dyeing or rolling, or on fastening of the male element to the hook-and-loop structure, and generally when a relatively high pressure is exerted on the side of the fabric provided with said loops, that the latter are randomly and irreversibly flattened, first affecting the efficiency of the hook-and-loop character of the structure and, further, affecting the appearance of this side, which phenomenon is amplified along the use of the fastening system. Such consequences are all the more prejudicial as they concern the visible side of the fabric.

The present invention aims at overcoming these disadvantages. It provides a fabric which is elastic in the warp direction, having one of its sides forming the female element of a hook-and-loop system, which has a very small thickness, typically in the range from 1.8 to 2 millimeters, in other words which develops qualities of fineness, flexibility, regularity of appearance and resistance to aggressions resulting from the hooks of the male portion of a hook-and-loop structure which are greatly improved with respect to prior art fabrics, and having, as a corollary, its other side as well as its edges intended to come into contact with the user's skin exhibiting remarkable qualities of comfort and softness.

BRIEF DESCRIPTION OF THE SPECIFICATION

The specification concerns a double-face fabric having elastic properties in its warp direction, formed by the weaving of warp yarns and of weft yarns, the warp yarns comprising at minimum four types of yarns:

elastic yarns worked in a taffeta weave;

synthetic yarns texturized by false twist on the face, intended to form the female element of the hook-and-loop fastening system, worked in a plain weave alternating with surface floats and having a linear strand density in the range from 10 to 25 dtex, having a hot air shrinkage rate of at least 5% (according to the DIN EN 14621 standard); a crimp contraction greater than 35%, a crimp modulus greater than 20% and a crimp stability greater than 65% (according to the DIN EN ISO 53840-T1 standard), so that after a finishing treatment (under a temperature typically in the range from 100 to 160° C.), said yarns are strongly retracted and pressed against the elastic yarns worked in taffeta and maintained by their tension at the center of the fabric;

multifilament synthetic yarns on the back, having a linear strand density in the range from 0.3 to 1.7 dtex worked in a rep weave, alternating floats of great length on the back side and short binding areas on the front side, and intended to ensure the comfort and the soft hand on the back side of the fabric, in the case in point typically intended to come into contact with the user's skin;

yarns used as binding yarns, exclusively formed of thermo-adhesive synthetic yarns, having a melting point in the range from 80 to 160° C., worked in a plain weave, ensuring at the same time, after the finishing treatment, the maintaining of the elastic yarns in the central portion of the fabric, the blocking of the face yarns, which form the female hook-and-loop element, and the blocking of the back yarns.

The texturizing by false twisting is a well known technology, which may be defined as a transformation of the flat synthetic yarns comprising giving them a permanent "crimp" by twisting/untwisting, which increases their apparent volume by providing them with a significant spring effect and elasticity. The measurement of this texturizing is performed according to a standard comprising three parameters characterizing the crimp, which may be simply defined by:

the crimp contraction representing the length ratio between a yarn section submitted to a 2 cN/tex force and the length of this same yarn section with no tension, the crimp modulus, which is the elongation capacity of the texturized yarns in the crimp elasticity range, the crimp stability, which is the ability of the texturized yarn to keep its crimp after a significant stretching (10 cN/tex for 10 min).

The weft being formed by a synthetic yarn.

In other words, the invention first comprises selecting a series of core yarns, on the face side, having specific characteristics, in the case in point having a hot air shrinkage of at least 5% and a high contraction power (typically greater than 35%), such properties generating a very strong retraction of the yarns during the finishing operation (from 100 to 160° C.) and enabling to obtain an extremely flat, compact and regular surface forming the female element of a hook-and-loop system.

Further, the use of thermo-adhesive yarns as binding yarns enables to press said series of core yarns, respectively back and face, against the inner surface of the article, resulting in a significant reduction of the thickness of said article typically in the range from 1.8 to 2 millimeters.

An elastic fabric having a planar front side forming the female element of a hook-and-loop fastening system, and having improved qualities of flexibility, appearance, and durability, and having an also planar even back side with a soft hand to ensure the user's comfort, is thereby obtained, which fabric has a particularly small thickness and an appearance which is not altered by the repeated use of the hook-and-loop function of said fabric.

According to the invention, the elastic yarns are formed by covered yarns having a 1240-decitex elastane core covered with a double cover of 2/78 decitex 23 strand texturized polyamide.

Still according to the invention:

the core yarns forming the face yarns are made of 220 dtex 10 strand texturized polyamide yarns, the core yarns forming the back yarns are made of 2/78 dtex 68 strand texturized polyamide yarns.

According to the invention, the yarns used for binding are made of a thermo-adhesive copolymer, having a linear density in the range from 80 to 180 dtex and a melting point in the range from 80° C. to 160° C.

This copolymer may be made of a thermo-adhesive copolyamide having a linear density close to 167 dtex and a melting point of 110° C. It might also be made of a thermo-adhesive copolyester, having the same linear density and a melting point of 145° C.

The weft yarns are advantageously made of texturized polyamide yarns, having a linear density close to 4/78 dtex 23 strands and the take-up of the finished fabric being 64 picks per inch.

According to an advantageous characteristic, part of the back yarns is capable of taking at the selvedge of the fabric a rep weave with a weave repeat of 2, tending to improve the resistance of the edges of said fabric while preserving the comfort.

BRIEF DESCRIPTION OF THE DRAWINGS

The foregoing features and advantages of the present invention will now be discussed in the following non-limiting description of a specific embodiment, in relation with the accompanying drawings.

DETAILED DESCRIPTION

Figure 1:
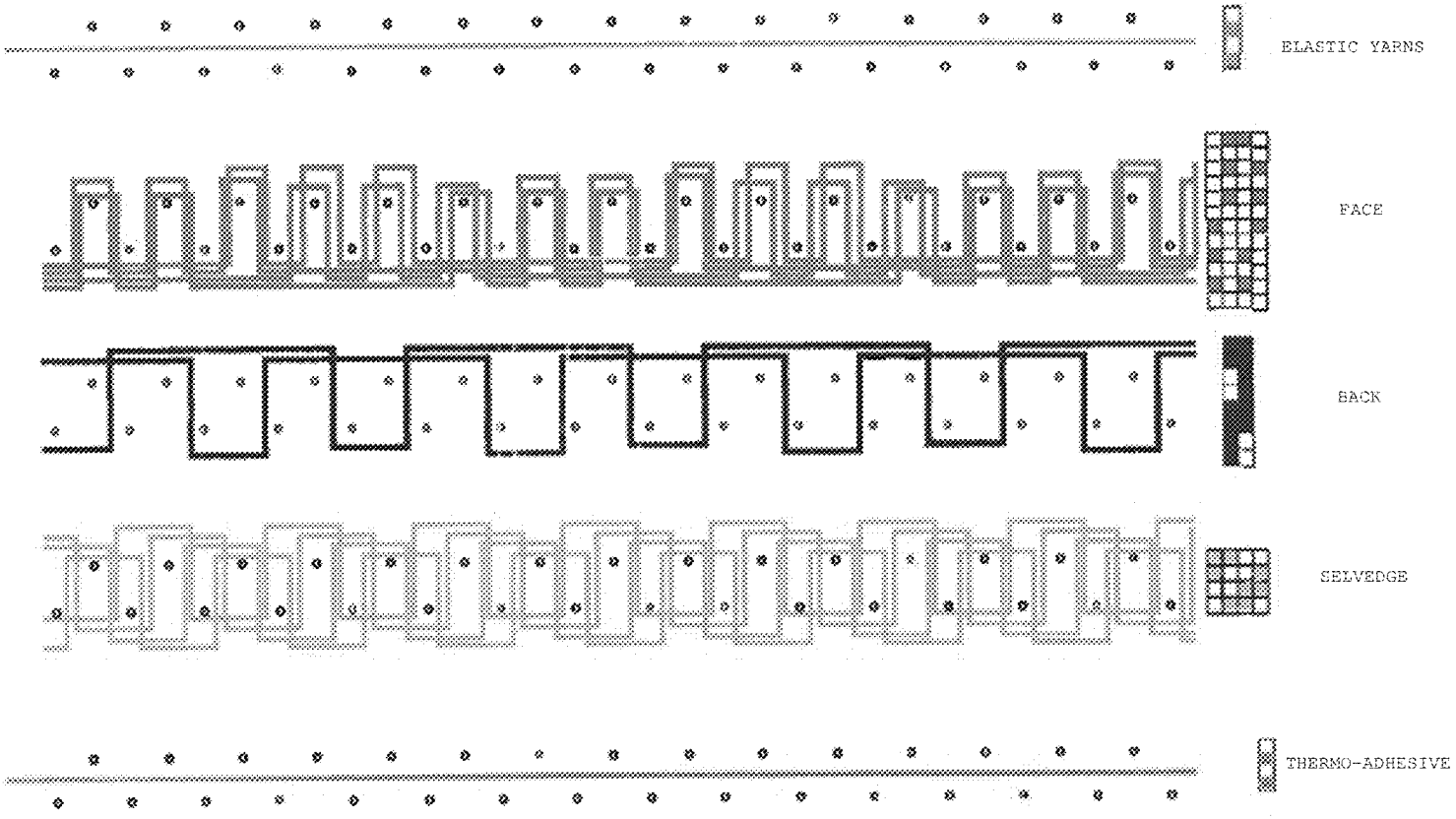
FIG. 1 schematically illustrates the working and the positioning of the warp yarns used in the manufacturing of fabrics according to the invention.

The following description is an embodiment of the invention, which is not meant to be limiting. In the case in point, it corresponds to a fabric obtained by means of a loom provided with a comb with 8.5 teeth per centimeter.

The warp of yarns of the fabric is formed of the following types of yarns:

elastic yarns (A) of covered yarns type formed of a 1240-decitex elastane core covered with a double cover of 2/78 decitex 23 strand texturized polyamide;

face yarns (B) each formed of a 220 decitex 10 strand texturized polyamide;

these yarns have (according to the DIN EN 14621 standard) a hot air shrinkage rate of at least 5% (according to the DIN EN ISO 53 840-T1 standard); a crimp contraction greater than 35%, a crimp modulus greater than 20% and a crimp stability greater than 65%;

back yarns (C), each formed of a 2/78 decitex 68 strand texturized polyamide yarn;

binding yarns (D), each formed of a thermo-adhesive copolyamide yarn of approximately 167 decitex, having a melting point of 110° C.

The weft (T) is formed by a 4/78 decitex 23 strand texturized polyamide yarn and the take-up of the finished fabric is 64 picks per inch.

Figure 2:
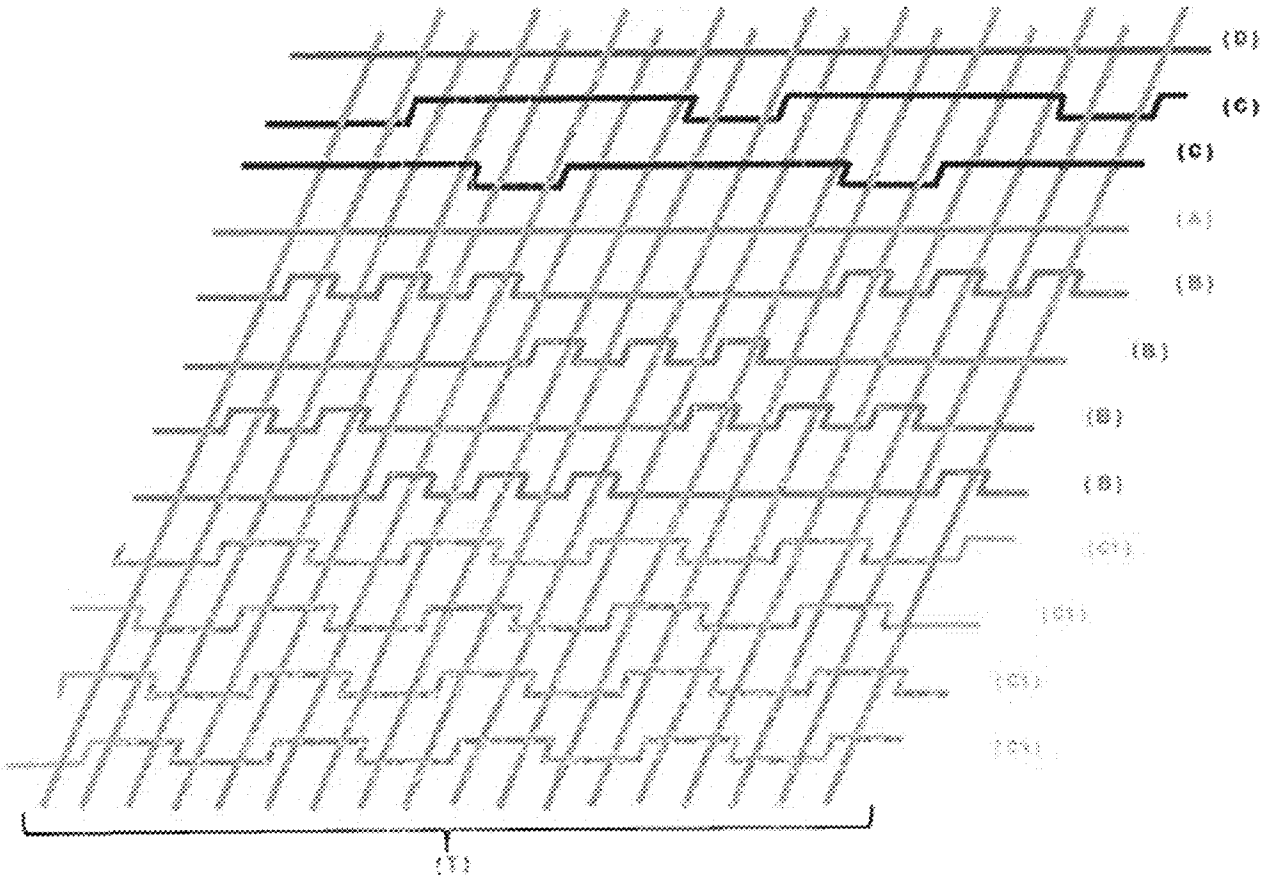
FIG. 2 is a simplified perspective view of the structure of the fabric of FIG. 1.
Figure 3:
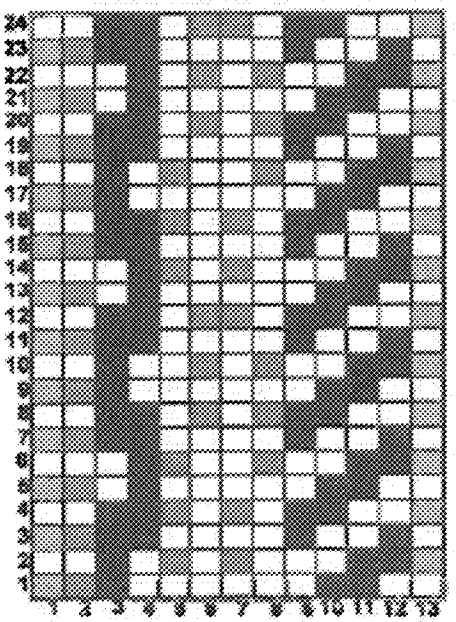
FIG. 3 is the conventional simplified representation of the weave repeat corresponding to the structure described in relation with FIGS. 1 and 2.
Figure 4:
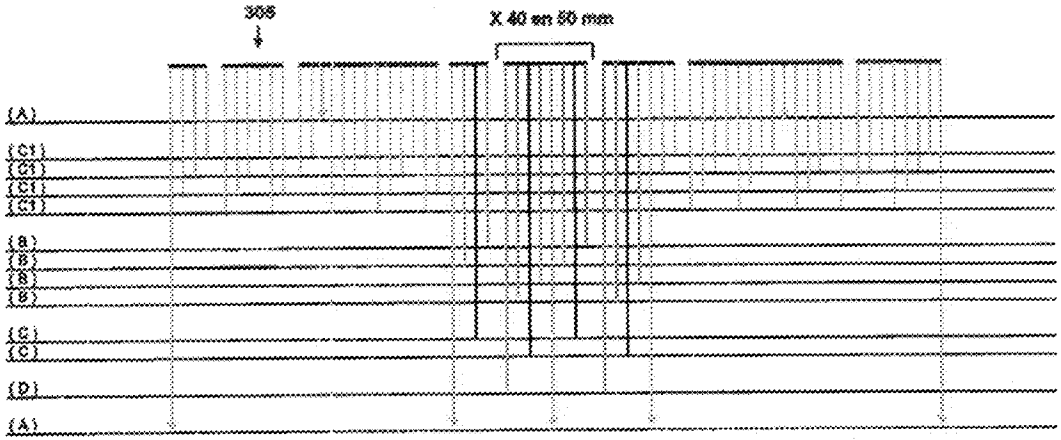
FIG. 4 schematically illustrates the loom threading draft for the forming of the fabric of FIGS. 1 to 3.

The weaving is performed according to FIGS. 1 to 4, which show that the elastic yarns (A) are worked in a taffeta weave while the face yarns (B) are worked in a weave alternating 7-pick float areas and 5-pick taffeta areas, the back yarns (C) are worked in a 6/2 rep weave, and finally the yarns ensuring the binding (D) are worked in a plain weave.

By doing so, an elastic fabric of very small thickness (~1.8 mm), having a flat, compact and regular face side enabling this side of the fabric to form the female element of a hook-and-loop fastening system, and developing a flexibility, an appearance, and a durability greatly improved with respect to prior art hook-and-loop elastic fabrics, and having an even back side with a soft hand which provides a remarkable comfort, quite appreciable when it is intended, which is most often the case, to be in contact with the user's skin, is obtained.

The above-described elastic fabric may be dyed by the various polyamide dyeing methods and the fusing temperature should be close to 120° C.

According to an advantageous feature, part (C1) of the back yarns takes at the selvedge of the fabric a rep weave with a weave repeat of 2, tending to improve the resistance of the edges of said fabric while preserving the comfort.

It is further important to note that the nature of the yarns used, as well as the design of the hook-and-loop elastic fabric of the invention, enables to cut it in all directions with the different techniques, including ultrasounds and laser, as well as to weld it by an ultrasound or high-frequency method or to glue it, which is a real advantage for all clothes making operations.

Further, it very small thickness (typically close to 1.8 mm) enables to use such a fabric for articles where, to date, the relative thickness and the lack of flexibility of existing systems did not allow it; such as for example the manufacturing of underwear, the manufacturing of finger orthoses, . . . , and generally uses which simultaneously require the qualities exhibited by this fabric.

The invention claimed is:

1. A double-face fabric having elastic properties in its warp direction and provided with hook-and-loop properties, formed by weaving of warp yarns and of weft yarns, and wherein the warp yarns are of four different types worked in different weaves with respect to the weft yarns, respectively:

elastic yarns (A) worked in a taffeta weave;

core yarns (B), formed of synthetic yarns texturized by false twist on the face, intended to form the female element of the hook-and-loop structure, worked in a plain weave alternating with surface floats and having a linear strand density in the range from 10 to 25 dtex, in addition to a hot air shrinkage rate of at least 5%; a crimp contraction greater than 35%, a crimp modulus greater than 20% and a crimp stability greater than 65%;

core yarns (C) on the back side, formed of multifilament synthetic yarns on the back, having a linear strand density in the range from 0.3 to 1.7 dtex worked in a rep weave, alternating floats of great length on the back side and short binding areas on the face side, and intended to ensure the comfort and the soft hand of this side of the fabric, yarns used as binding yarns, exclusively formed of thermo-adhesive synthetic yarns, having a melting point in the range from 80° C. to 160° C., worked in a plain weave, ensuring the maintaining of the extensible yarns in the central portion of the fabric and ensuring, after the finishing treatment, the blocking of the core yarns (B) (face yarns), forming the female element of the hook-and-loop system, and the blocking of the core yarns (C) (back yarns).

2. The double-face fabric having elastic properties in its warp direction and provided with hook-and-loop properties according to claim 1, wherein the elastic yarns (A) are formed by covered yarns having a 1240-decitex elastane core covered with a double cover of 2/78 decitex 23 strand texturized polyamide yarns.

3. The double-face fabric having elastic properties in its warp direction and provided with hook-and-loop properties according to claim 1, wherein the face core yarns (B) are formed by 220 dtex 10 strand texturized polyamide yarns having a hot air shrinkage is in the order of 8%.

4. The double-face fabric having elastic properties in its warp direction and provided with hook-and-loop properties according to claim 1, wherein the back core yarns (C) are formed by 2/78 dtex 68 strand texturized polyamide yarns.

5. The double-face fabric having elastic properties in its warp direction and provided with hook-and-loop properties according to claim 1, wherein the yarns used for binding (D) are formed of a thermo-adhesive copolymer, having a linear density in the range from 80 to 180 dtex and a melting point in the range from 80° C. to 160° C.

6. The double-face fabric having elastic properties in its warp direction and provided with hook-and-loop properties according to claim 5, wherein thermo-adhesive copolymer is selected from the group comprising thermo-adhesive copolyamide having a linear density close to 167 dtex and a melting point of 110° C. and thermo-adhesive copolyester, having a linear density close to 167 dtex and a melting point of 145° C.

7. The double-face fabric having elastic properties in its warp direction and provided with hook-and-loop properties according to claim 1, wherein the weft yarns (T) are formed by 4/78 dtex 23 strand texturized polyamide yarns, the take-up of the finished fabric being 64 picks per inch.

8. The double-face fabric having elastic properties in its warp direction and provided with hook-and-loop properties according to claim 1, wherein part (C1) of the core yarns (back yarns) takes at the selvedge of the fabric a rep weave with a weave repeat of 2, tending to improve the resistance of the edges of said fabric while preserving the comfort.

* * * * *